US008555532B2

(12) United States Patent
Lopez Almendros et al.

(10) Patent No.: US 8,555,532 B2
(45) **Date of Patent: *Oct. 15, 2013**

(54) DETACHABLE FASTENING SYSTEM BETWEEN A MALE PIECE AND A FEMALE PIECE, PIN AND FEMALE PIECE

(75) Inventors: Jose Lopez Almendros, Barcelona (ES); Francisco Perez Soria, Barcelona (ES); Angel Martinez, Barcelona (ES)

(73) Assignee: Metalogenia, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 12/524,296

(22) PCT Filed: Mar. 28, 2007

(86) PCT No.: PCT/ES2007/000169

§ 371 (c)(1), (2), (4) Date: Jan. 15, 2010

(87) PCT Pub. No.: WO2008/116942

PCT Pub. Date: Oct. 2, 2008

(65) Prior Publication Data

US 2010/0115804 A1 May 13, 2010

(51) Int. Cl.
*E02F 9/28* (2006.01)

(52) U.S. Cl.
USPC ..... 37/456; 37/455; 172/772

(58) Field of Classification Search
USPC ..... 37/452, 456, 457, 450, 451, 453, 454, 37/455, 458, 459, 460
See application file for complete search history.

(56) References Cited

U.S. PATENT DOCUMENTS

| | | | | | |
|---|---|---|---|---|---|
| 2,064,059 | A | | 12/1936 | Fellmeth | |
| 3,511,126 | A | * | 5/1970 | Watts | 411/512 |
| 4,213,257 | A | | 7/1980 | Johansson et al. | |
| 4,233,761 | A | * | 11/1980 | Ryerson | 37/452 |
| 4,326,348 | A | | 4/1982 | Emrich | |
| 4,481,728 | A | | 11/1984 | Mulder et al. | |
| 5,718,070 | A | | 2/1998 | Ruvang | |
| 5,765,301 | A | * | 6/1998 | Clendenning | 37/457 |
| 5,913,605 | A | * | 6/1999 | Jusselin et al. | 37/451 |
| 5,937,550 | A | | 8/1999 | Emrich | |
| 5,987,787 | A | * | 11/1999 | Mack | 37/456 |
| 5,992,063 | A | * | 11/1999 | Mack | 37/450 |
| 6,018,896 | A | * | 2/2000 | Adamic | 37/456 |

(Continued)

FOREIGN PATENT DOCUMENTS

WO 2005/095720 A1 10/2005

*Primary Examiner* — Jamie L McGowan
(74) *Attorney, Agent, or Firm* — Sughrue Mion, PLLC

(57) ABSTRACT

Detachable fastening system between a male piece (2) and a female piece (1), pin (3) and female piece (1), specifically for use in machines for moving earth and stones. It is formed by a tooth (2) with a transverse aperture, a tooth holder (2) with another transverse aperture, a pin with an intermediate nipple, and an elastic tensor (4) located in a complementary cavity of the tooth holder (2). The penetration and subsequent rotation of the pin (3) immobilizes it axially, as it is held in said angular position by the action of the tensor (4). In addition, the pin (3) has at one end a projection that interacts with a groove ramped helicoidally and fitted in the aperture of the tooth in order to absorb the axial forces, by unloading the tensor (4) thereof, and also in order to limit the angular distance travelled by the pin between the blocking and unblocking positions, and in order to facilitate possible extraction thereof.

44 Claims, 10 Drawing Sheets

(56) References Cited

U.S. PATENT DOCUMENTS

| | | | | |
|---|---|---|---|---|
| 6,092,958 | A | 7/2000 | Gale | |
| 6,108,950 | A * | 8/2000 | Ruvang et al. | 37/452 |
| 6,393,739 | B1 | 5/2002 | Shamblin et al. | |
| 6,430,851 | B1 | 8/2002 | Clendenning | |
| 6,439,796 | B1 | 8/2002 | Ruvang et al. | |
| 6,757,995 | B2 * | 7/2004 | Pippins | 37/468 |
| 7,069,676 | B2 * | 7/2006 | Robinson et al. | 37/457 |
| 7,162,818 | B2 * | 1/2007 | Ruvang et al. | 37/456 |
| 7,174,661 | B2 * | 2/2007 | Briscoe | 37/455 |
| 7,178,274 | B2 | 2/2007 | Emrich | |
| 7,526,886 | B2 | 5/2009 | McClanahan et al. | |
| 7,640,685 | B2 * | 1/2010 | Emrich | 37/457 |
| 7,707,755 | B2 * | 5/2010 | Lopez Almendros et al. | 37/457 |
| 7,788,830 | B2 * | 9/2010 | Woerman et al. | 37/456 |
| 2003/0037467 | A1 | 2/2003 | Bierwith | |
| 2003/0101627 | A1 | 6/2003 | Robinson et al. | |
| 2005/0095720 | A1 | 5/2005 | Lorber et al. | |
| 2007/0107274 | A1 | 5/2007 | Livesay et al. | |
| 2007/0209189 | A1 | 9/2007 | Lopez Almendros et al. | |

* cited by examiner

DETACHABLE FASTENING SYSTEM BETWEEN A MALE PIECE AND A FEMALE PIECE, PIN AND FEMALE PIECE

FIELD OF THE INVENTION

The present invention relates to a detachable fastening system between a male piece and a female piece, particularly between a tooth and a tooth holder, and is formed by a tooth, a tooth holder, a pin with an incorporated retaining element which removably blocks said teeth with respect to the tooth holder, and an elastically loaded tensor element, such that the various elements collaborate to prevent the pin from coming out of its blocking position and thus maintain the tooth and tooth holder fastened.

The field of application of the present invention is any in which the mechanical fastening between a male piece and a female piece must be performed, and particularly it can be applied in the sector of moving materials, such as earth and stones, in which the bucket of an excavator is provided with a tooth holder to which teeth are detachably secured, thus allowing the replacement thereof.

TECHNICAL BACKGROUND

Machines for moving materials such as earth and stones, including excavators and the like, and other machines used in public works and mining, are used for pulling up, moving and loading earth, stones and the like. These machines, which can be presented under a variety of configurations, are usually provided with one or more buckets attached to a mechanical arm. The bucket is provided with a blade or beveled lip on a front edge intended to strike and penetrate the mass of earth and stones. To prevent excessive wear of the blade and to aid in penetrating the earth, it is common to assemble wear elements or teeth associated to the blade and projecting in front of same. However, said teeth are also subjected to wear and breakages, therefore they must be replaced often, and on the other hand, depending on the work for which the machine is intended, it may be desirable to change the type or the shape of the teeth. In order to facilitate said replacement, tooth holders are used, which are secured to the blade of the bucket in a more or less permanent manner, and the teeth are releasably assembled in the tooth holder by means of pins. Said pins usually traverse apertures of the tooth and a passage traversing the tooth holder for the purpose of securing the tooth to the tooth holder.

To prevent the pin from coming out of its assembly position, a retaining device is used, which device maintains the pin in said assembly position. The retaining device normally includes elastic elements having the function of exerting pressure on the retainer so that the latter remains in its assembly position. In working conditions, the system receives forces and blows in all directions, making the system move and reacting in an unwanted manner, causing internal wear and shifting the pin. The pin can then come out of the tooth holder, the pin and the tooth possibly being lost. The loss of a tooth and/or pin can be very important depending on the work site thereof, given that they can cause other machines to break down, such as crushers, working in the same production site as the machine using the teeth, such as for example mines or quarries.

Patent application number WO-2005095720-A1 describes a device for the detachable fastening of two mechanical pieces, comprising a pin which removably blocks a first piece with respect to a second piece, a retaining element associated to the pin and an elastically loaded tensor element, collaborating to prevent the pin from coming out of its blocking position; in this system it further comprises at least two inclined planes the general shape of which is that of a projection oriented in the axial direction of the pin, such that upon rotating the pin, the retaining element travels said inclined planes and the pin moves between two positions, the blocking position and the unblocking position or the introduction position of the pin, against the axial force exerted by said tensor element in the direction of the axis of the pin.

In combination with the elastic load of the tensor element and the retaining element, the two inclined planes make it very difficult for the pin, with said retaining element, to come out of its blocking position. During its working operation, the pin can receive both longitudinal and transverse stressing, but it will be difficult for it to receive stresses causing a rotation thereof, such that the retainer of the pin cannot rotate from its blocking position upon introducing the pin in the cavity formed by the male piece and the female piece.

In the blocking position, the pin is completely introduced in the channel or housing forming the apertures of the tooth and of the tooth holder, the pin preferably not being a through pin, i.e., it does not traverse the two sides of the tooth, only one of them for the introduction thereof. When the tooth is worn or the design thereof has to be changed, it will be necessary to first remove the pin. In this type of system, the stresses for disassembly are greater than those for the assembly, because in addition to the difficulties characteristic of the design and construction, the disassembly is affected because during the work, the pin and the retaining element can become deformed in addition to earth being introduced in the housing of the pin, making the extraction thereof difficult.

The movements of the fastening device under extreme working conditions are unpredictable and often uncontrollable. After several hours of working in a number of field tests, it was found that the pin had experienced movement in an unwanted direction; specifically it had shifted with respect to its working or blocking position, towards the end opposite that for introducing the pin in the tooth. In other words, as the end of the pin introduced in the tooth holder had shifted, it tends to come out through the aperture of the tooth opposite the introduction aperture for introducing it. In the blocking position, the retainer of the pin is located between an inner wall of the tooth and a wall of the tensor, and due to the stress in work, the pin moves in the only direction that is not limited, which is towards the tensor due to the fact that the material thereof is not as hard as that of the tooth.

If the pin shifts from its blocking position such that the end of the pin introduced in the tooth holder projects through the aperture of the tooth opposite the introduction aperture for introducing it, the pin thus being exposed to unwanted wear. Furthermore, upon receiving the constant pressure exerted by the retainer of the pin, the tensor is damaged, losing its technical characteristics.

In the rotation for assembling the pin in application number WO-2005095720-A1, the internal rotation of the retainer is not visibly controllable from the outside, therefore the retainer rotates until it has travelled along the entire surface of the tensor, coming out of contact with the tensor and being housed between the tensor and a wall of the cavity of the tensor existing in the tooth holder.

The unwanted housing of the retainer of the pin between the tensor and a wall of the cavity of the tensor, in addition to a possible constant pressure of the retainer on the tensor, make it difficult to extract the pin from the tooth-tooth holder system.

BRIEF DESCRIPTION OF THE INVENTION

For the purpose of overcoming the mentioned drawbacks and for simplifying and improving the assembly and disassembly of a tooth in a tooth holder, and more generally, of two mechanical pieces, a female piece and another male piece, to one another, the fastening system object of the present invention is formed by a tooth, a tooth holder, a fastening element of both or pin which is introduced in a housing formed by the tooth and tooth holder, said pin having a retaining element, a projection at the end of the pin which is not introduced in the tooth holder and an elastically loaded tensor element. The projection of the pin, located at the end of the pin which is not introduced in the tooth holder, has a preferably planar upper face or surface, and another lower one, determining a maximum thickness of the projection, in which the lower face or surface is arranged with a certain inclination with respect to the upper face forming a ramp in the shape of a thread crest or helix. The projection further has a front face preferably secant to the body of the pin although it could also be tangent or normal. The tooth also has a cavity in the shape of an arc or chord of a circle adjacent to the hole for introducing the pin, said cavity having an inclination opposite the inclination of the lower wall of the projection of the pin. The inclination has a starting point with a preferably nil depth with respect to the beginning of the aperture of the tooth and an end point with a depth determined by the length necessary for the retainer of the pin to reach the position which allows the blocking. The cavity thus has a section in the shape of the root of the thread which is coupled with the ramp of the threaded retaining element of the pin.

The systems for the detachable fastening between tooth and tooth holder usually have a pin securing the tooth-tooth holder assembly the body of which has the shape of a surface of revolution. Said body of the pin can be frustoconical in order to facilitate introducing and extracting the pin, or cylindrical. The pin is also preferably not a through pin, i.e., it does not traverse the two sides of the tooth, preventing wear from occurring at the ends of the pin. The length of the pin can encompass the entire channel or housing formed by the width of the tooth between the opposite apertures for the entrance and possible exit in the tooth. It is also possible for the length of the pin to reach only a mid-point of the duct or housing of the tooth holder.

As mentioned, the system also includes a tensor formed by a flexible piece which is compressed when pressure is applied. The tensor is located in a cavity, either of the tooth or of the tooth holder, interacting between them. Said cavity is adjacent to the entrance to the housing or duct of the tooth holder. The pin has a retaining element the function of which is to maintain and/or secure the pin in the blocking position, thus preventing the shifting thereof outwards.

For the assembly of the system, first the tensor element is placed in the cavity of the tensor, then the tooth is introduced on the tooth holder, then the pin is introduced in the channel or housing formed by an opening assembled in the surface of the tooth and the duct or channel traversing the tooth holder. It is also possible for the system to be formed by a tooth holder with a cavity, and the nose or projection is in the tooth, such that the tensor would be located in a cavity of the tooth and the ramp adjacent to the aperture which collaborates with the ramp of the projection of the pin would be located in the tooth holder.

In view of the foregoing, it is evident that the tooth can be a male piece to be housed in the tooth holder, or a female piece so that the tooth holder is housed inside the tooth, and depending on the foregoing, the tooth holder will be a female piece or a male piece, respectively.

The retaining element of the pin enters through a groove arranged in said opening. When the tooth holder is a male piece, it does not have said groove given that the retaining element must remain between the inner surface of the tooth and the outer surface of the tooth holder, in a cavity arranged between both pieces, specifically between the tensor element and the inner surface of the tooth.

Once the pin and the retaining element are introduced, the system is located in the introduction/unblocking position of the pin prior to the blocking of the system. In order to achieve said blocking, a rotational movement is applied to the pin, and therefore to the retainer, such that the latter shifts from the introduction position to the blocking position through inclined planes arranged in the surface of the tensor. In order to overcome said inclined planes of the tensor, it is necessary to apply pressure on the pin, specifically the retaining element against the surface of the tensor which, as it is an elastic material, it is compressed and the retainer is left to pass, overcoming the inclined planes. Upon being compressed, the tensor exerts a force opposite that of the pressure of the pin in its axial axis.

In the blocking position, the retaining element is located in a cavity, in which the tensor no longer exerts the force of pressure and limited on one side by the inner surface of the tooth and on the opposite side by the elastic surface of the tensor element.

At the end of the pin which is not introduced in the tooth holder, as previously described, the pin as a projection the ramp of which arranged in the lower surface of the projection contacts with a cavity in a ramp adjacent to the hole of the pin existing in the tooth, such that upon the pin rotating on the same axis as the housing in which the pin is introduced, the projection is threaded or screwed to the tooth with approximately a quarter of a rotation.

In its assembly position, the retainer is fastened between the inner surface of the tooth and the tensor made of elastic material. Due to the fact that the hardness of the tensor is less than that of the tooth, under extreme working conditions in which the movements of the pin and of the retainer are inevitable and unpredictable, the pin moves in the only direction it can, which is in the direction in which the tensor is located, exerting pressure on it. The foregoing makes the lower end of the pin come out through the aperture opposite that of the introduction of the tooth, exposing that end to unwanted wear. Furthermore, permanent pressure in the retainer can damage its mechanical characteristics, preventing it from carrying out its function which is that of immobilizing and/or maintaining the retainer in its blocking position. The contact of the ramp of the projection of the pin with the cavity adjacent to the entrance aperture of the pin in the tooth in the blocking position acts as a mechanical stop to prevent the pin from shifting out of its blocking or working position, particularly preventing the end of the pin introduced in the tooth holder from projecting through the aperture of the tooth opposite the introduction aperture, thus preventing the pin from being exposed to unwanted wear.

The shape of the projection of the pin at the end opposite that of introduction in the tooth holder is formed by a preferably planar upper face, and a lower face, with a certain inclination with respect to the upper face such that it forms a ramp in the shape of a thread crest or helix. Said projection further has a front face preferably secant to the body of the pin, although it could also be tangent or normal, in which the front face contacts with an opposite plane, located in the groove of the introduction aperture for introducing the pin in the tooth. This contact acts as a second mechanical stop to control the rotation of the retainer, preventing the retainer from coming out, in an excessive rotation, of the contact with the tensor and thus preventing it from being housed in an unwanted manner between the tensor element and an inner wall of the cavity for the tensor.

In the extraction, the force for the rotation must be greater than and opposite the force in the rotation of the assembly and the assembly area must be filled with packed fines along the entire fastening system and the working conditions may have affected the condition of the components of the system.

The geometry of implementing the present invention converts the rotational force applicable for the disassembly of the pin into a rectilinear movement towards the disassembly direction, which is the same as the assembly direction but in the opposite direction. This rectilinear movement allows the pin to come out of its blocking position, the walls of the pin of the channel formed by the apertures of the tooth and of the tooth holder being separated, this unblocking being able to be complicated due to the packed fines which may have been introduced in the hollows existing between the various pieces of the system.

Upon removing the pin from its blocking position and shifting it outwards, access to the upper end of the pin is easier, which allows extracting it without problems.

As previously mentioned, the extreme working conditions and their effects in the system are uncontrollable, therefore after having extracted the pin from its blocking area, the fines make it even more difficult to completely extract the pin from the housing. To that end and once the pin is released with rotational movement, the ramp of the projection of the pin and the surface of the ramp adjacent to the hole of the pin are somewhat separated, a tip of a tool being able to be introduced between the two ramps by supporting the tip of the tool in the ramp of the cavity in order to be able to make a lever effort between the two surfaces, and to thus be able to apply more force in order to finish extracting the pin.

DESCRIPTION OF THE DRAWINGS

In order to further understand the foregoing, drawings are attached which schematically and only by way of a non-limiting example depict several practical embodiments. In the drawings.

DETAILED DESCRIPTION OF SEVERAL EMBODIMENTS

Several embodiments of the invention are described below which are applied, by way of example, to the assembly and disassembly of a tooth in a tooth holder of a bucket of an excavating machine.

Figure 1:
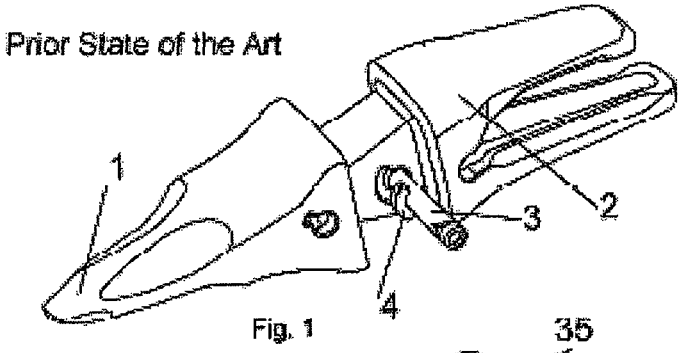
FIG. 1 is a perspective view of a tooth-tooth holder assembly of a bucket of an excavating machine with a device according to the prior state of the art.
Figure 2:
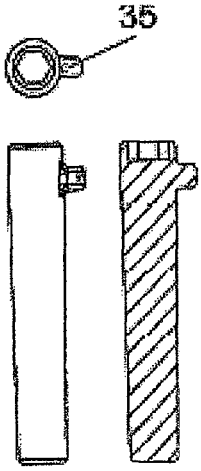
FIG. 2 shows three views of a pin used in the state of the art.
Figure 3:
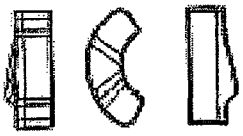
FIG. 3 shows three views of a tensor used in the state of the art.
Figure 4:
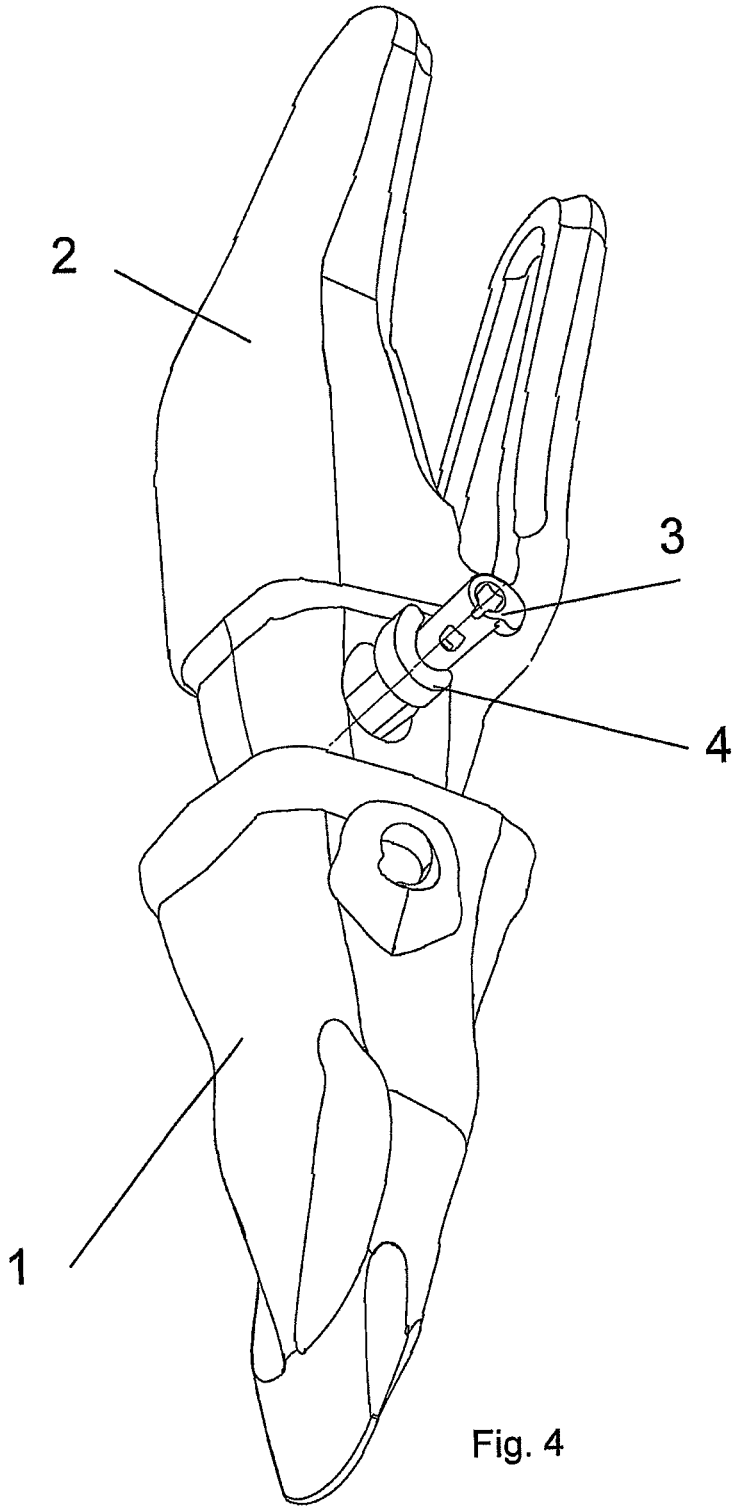
FIG. 4 is a perspective view of a tooth-tooth holder assembly of a bucket of an excavating machine with a device according to an embodiment of the invention.
Figure 5:
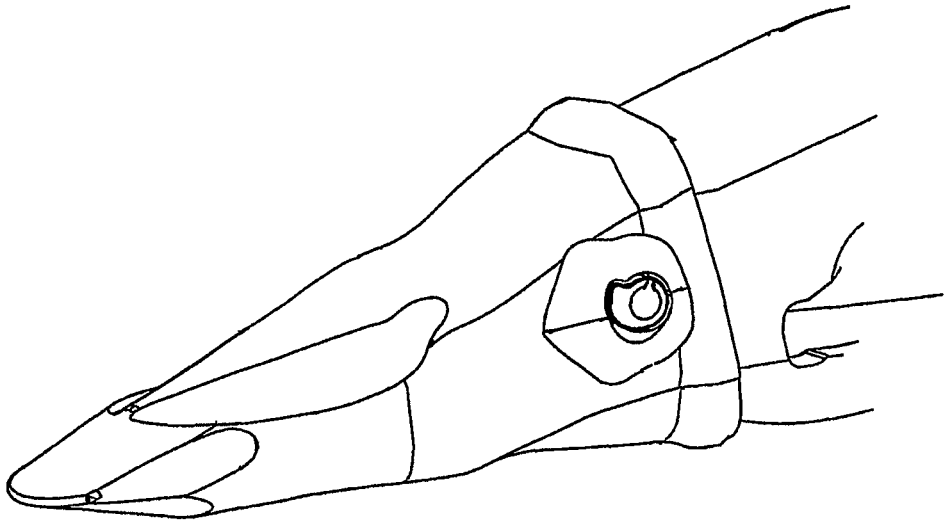
FIG. 5 is the tooth and pin assembly in the blocking position.
Figure 6:
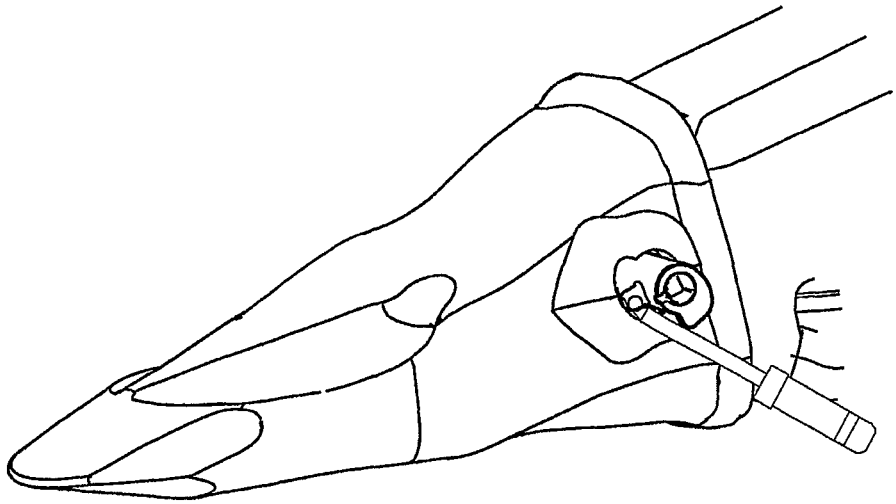
FIG. 6 is a tooth and pin assembly in the extraction position with the aid of a tool for acting as a lever.
Figure 7:
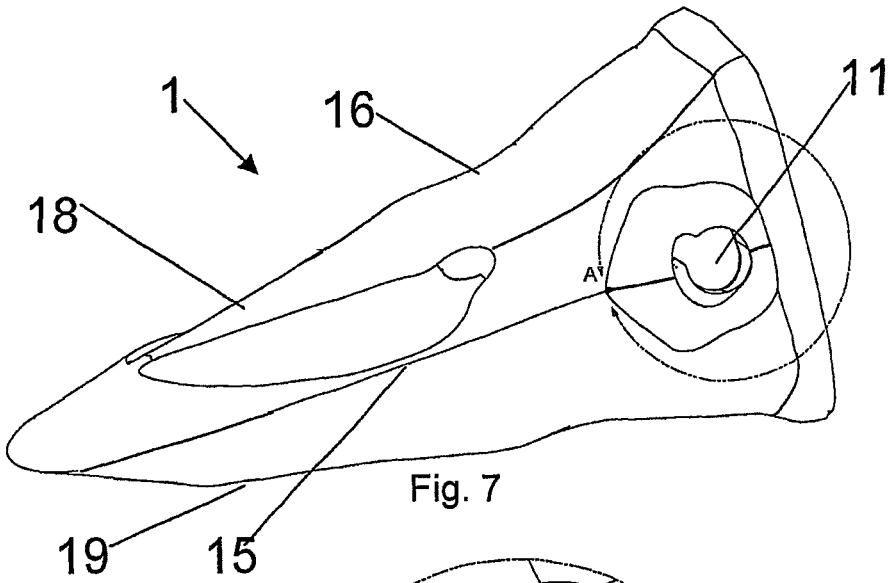
FIG. 7 is a perspective view of a tooth.
Figure 8:
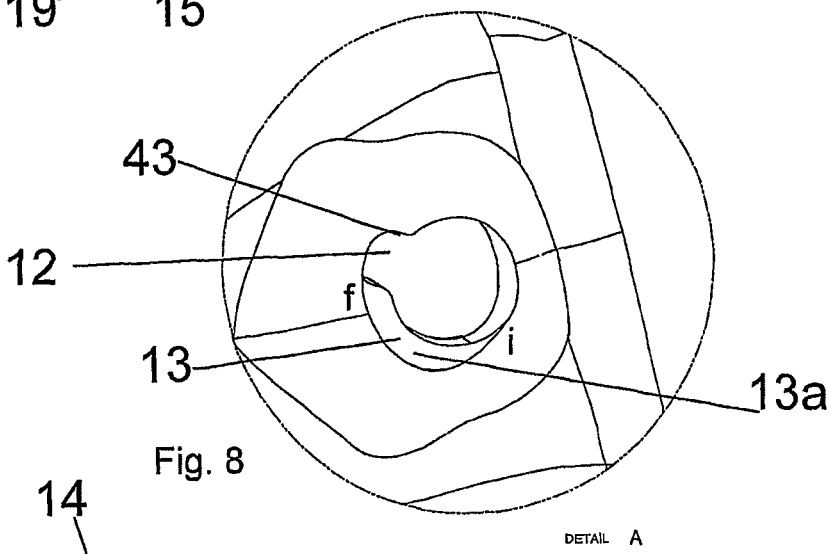
FIG. 8 is a perspective view of a detail of the hole of the tooth of FIG. 7.
Figure 9:
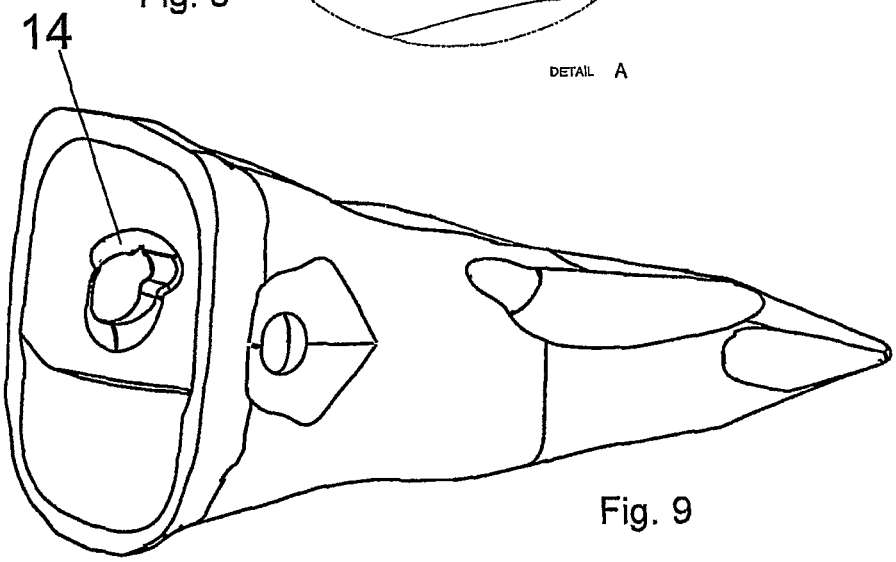
FIG. 9 is a rear perspective view of a tooth.
Figure 10:
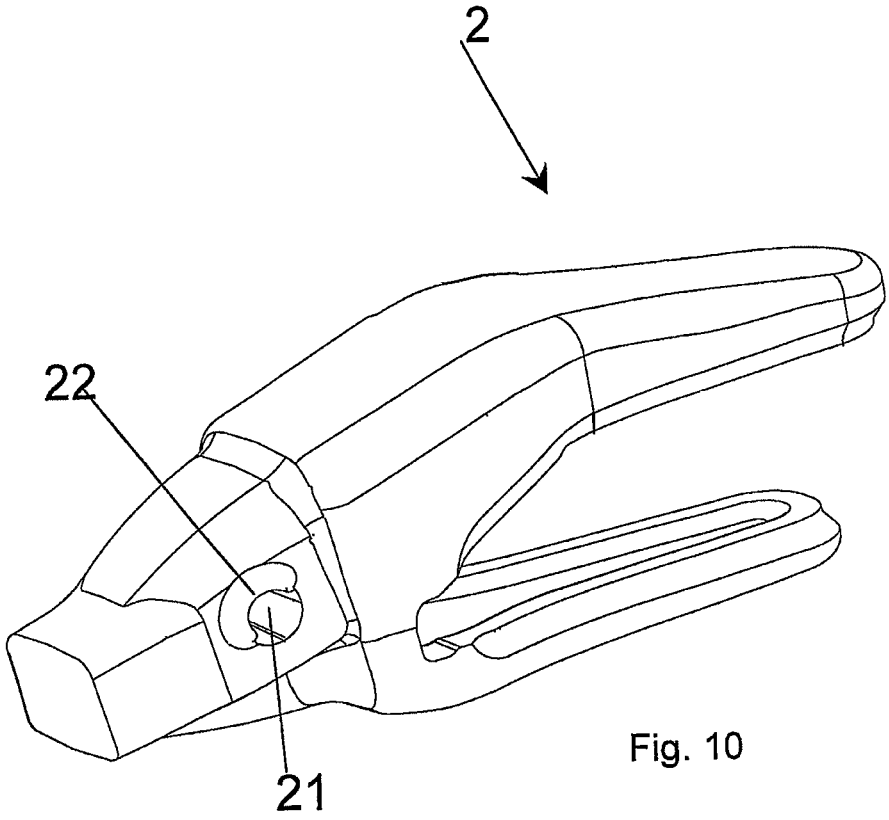
FIG. 10 is a perspective view of a tooth holder.
Figure 11:
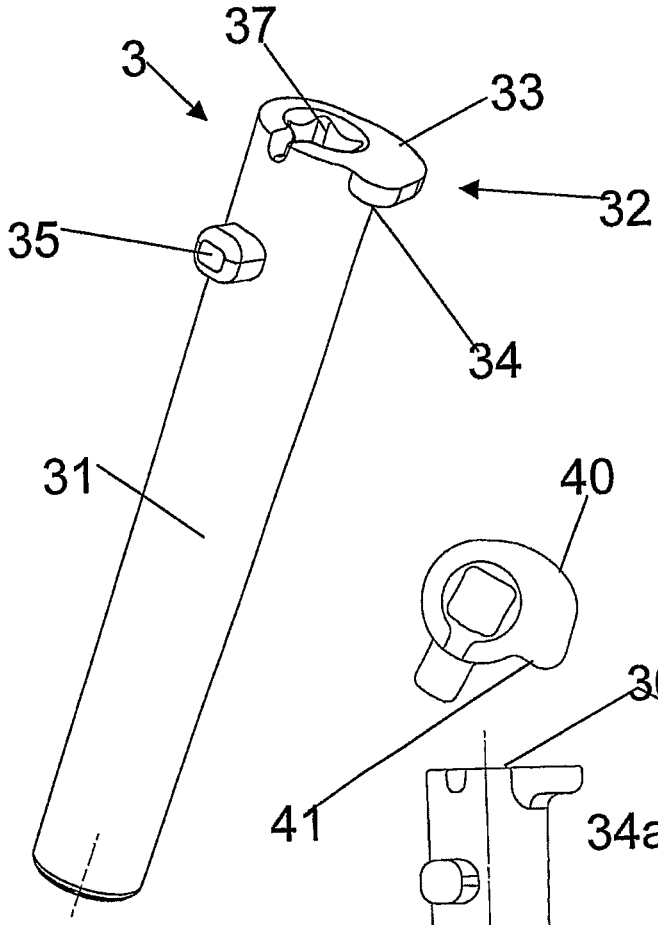
FIG. 11 is a perspective view of a pin.
Figure 12:
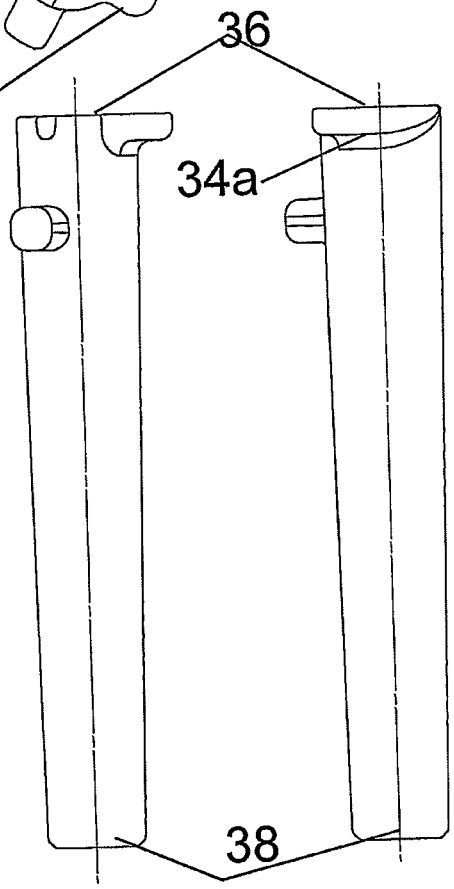
FIG. 12 shows three views of a pin.
Figure 13:
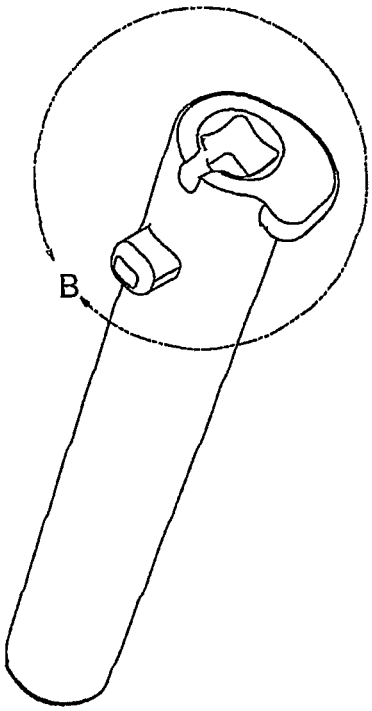
FIG. 13 is an upper perspective view of a pin.
Figure 14:
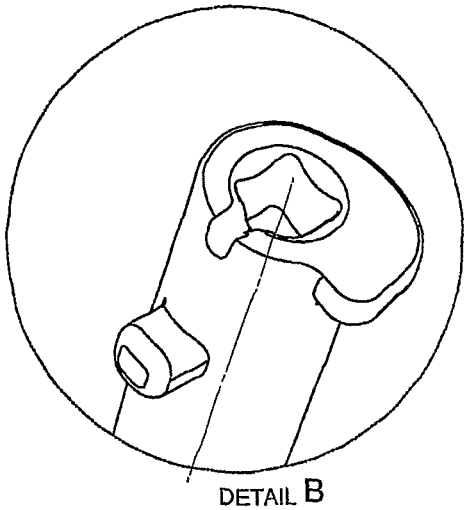
FIG. 14 is a detail of the upper end of the pin.

In reference to FIGS. 1 to 3, which show solutions of the prior state of the art, a tooth-tooth holder assembly is observed comprising a tooth 1 which determines a hollow, a tooth holder 2 with a nose which is housed inside the hollow of the tooth 1, a pin 3, a retainer associated to the pin 5 and an elastic tensor element 35.

The following figures refer to a fastening system object of the present invention, between a tooth 1 and a tooth holder 2, in which a pin 3 detachably blocks the tooth 1 with respect to the tooth holder 2, and a retaining element 35 associated to the pin 3 together with an elastically loaded tensor element 4 collaborate to prevent the pin from coming out of its blocking position. A pin is described in the embodiment with a length encompassing the entire channel or housing of the tooth holder but it is possible that it may only reach an intermediate point of the channel or housing of the tooth holder.

The pin 3 is provided with a body 31, the shape of which is that of a preferably frustoconical surface of revolution, a retaining element 35 having the function of maintaining the pin in the assembly position.

The end of the pin 3 which is not introduced in the tooth has a recess 37 with the suitable shape for coupling a tool by means of which a rotational movement can be applied to the pin about its longitudinal axis.

Figure 15:
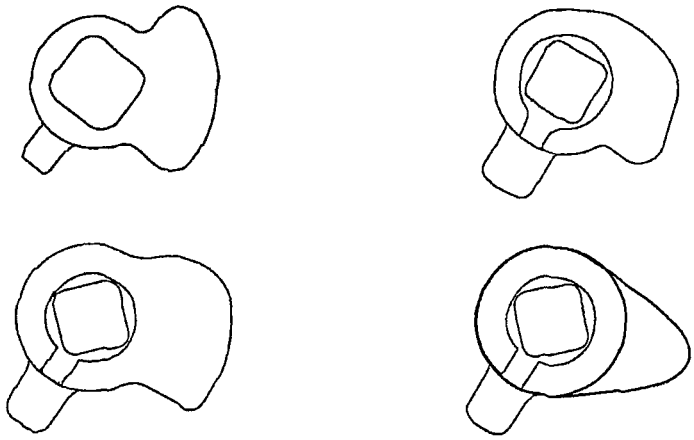
FIG. 15 shows different configurations of the plan view of the upper projection of the pin.
Figure 16:
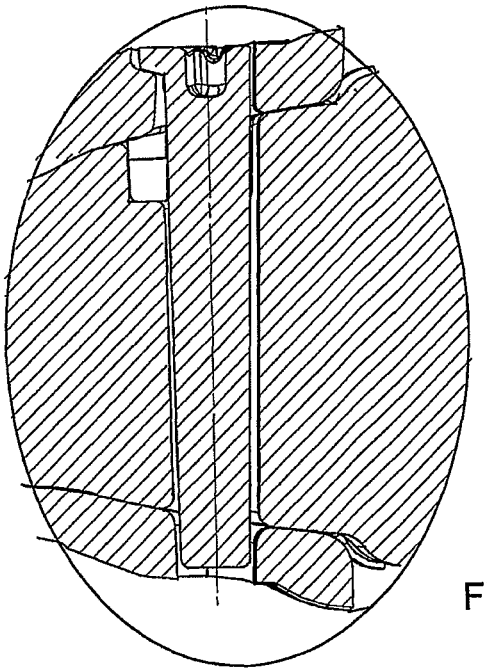
FIG. 16 is a detail of the pin in the blocking position in a longitudinal section.
Figure 17:
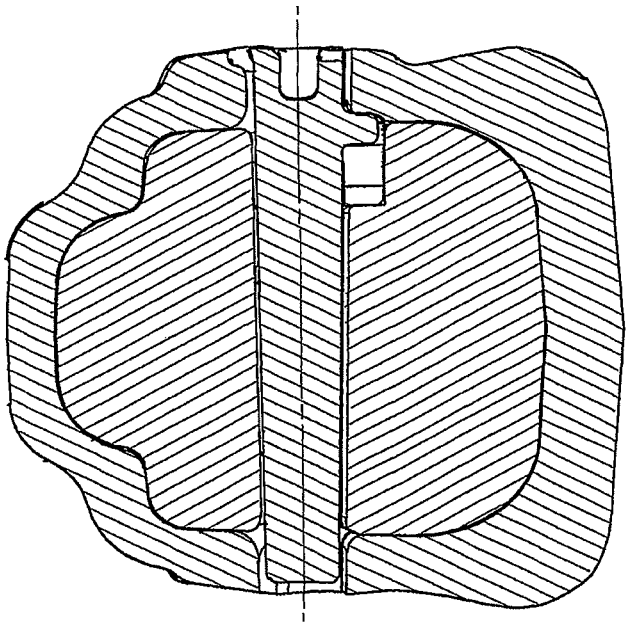
FIG. 17 is a detail of the pin in the blocking position in a cross section.
Figure 18:
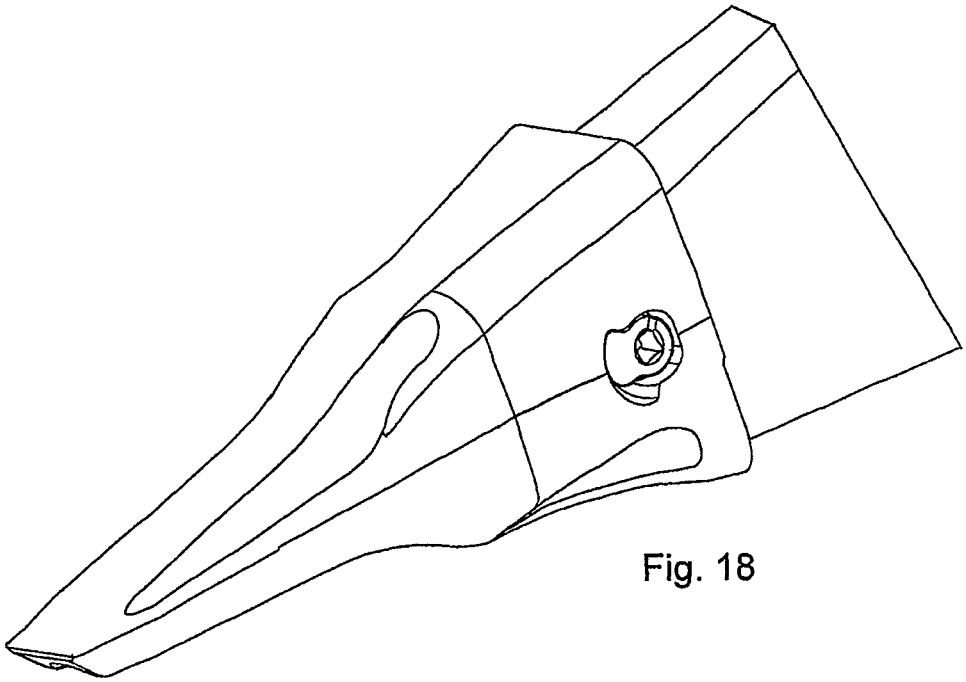
FIG. 18 is a perspective view of a tooth-tooth holder assembly of a bucket of an excavating machine with a device according to another embodiment of the invention.
Figure 19:
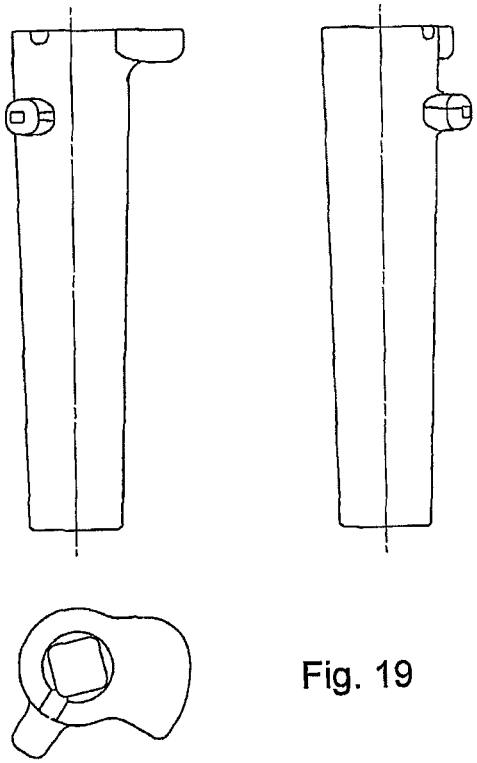
FIG. 19 shows three views of a pin used in the system of FIG. 18.

The pin 3 is provided with a projection 32 located at the end of the pin which is not introduced in the tooth. The projection 32 has a preferably planar upper face 33 and another lower face 34, in which the lower face 34 is arranged at a certain inclination from the upper face 33 forming a ramp 34*a*. The projection further has a front face 41 preferably secant to the body of the pin but it can also be tangent or normal, as can be observed in FIG. 15.

The inclination of the slope 34*a* begins with a thickness tending to 0 and the thickness gradually increases as it reaches a maximum thickness. The maximum thickness is that necessary so that in a quarter of a rotation it allows the retainer to be located between the tooth and the tooth holder, more specifically between the tooth and the tensor, which is located inside the cavity 22 of the tooth holder 2. In this embodiment of the invention, the ramp 34*a* has the shape of a helix, but this surface could be planar or curved.

The tooth 1 is formed by an upper wall 18 a lower wall 19 and two side walls 15 and 16, it is further provided with at least one through aperture 11 in one of the side walls 15 or 16. Said aperture has a groove 12 in order to introduce the retaining element 35 of the pin 3.

Adjacent to the aperture 11 of the tooth there is a cavity 13 which is introduced or included in the wall of the aperture 11 in the shape of an arc or chord of a circle, this cavity 13 having an inclination like a ramp such that the surface or inclined face of said ramp is planar (13*a*), also being able to be arched, concave or convex. The inclination of said ramp of the cavity 13 is opposite the inclination of the lower wall of the projection 32 of the pin 3. Said cavity 13 has a starting point (i) with a preferably nil depth at the height of the outer surface 15 of the tooth 1 and an end point (f) with a depth which is defined by the length necessary for the retainer 35 of the pin 3 to reach the position which allows the blocking, i.e., in the cavity formed by the tensor 4 and a wall or inner surface 14 of the tooth. Obviously, the height or depth of the ramp 13*a* is limited by the thickness of the wall in which introduction aperture 11 for introducing the pin 3 in the tooth 1 is included, said height or depth being able to be less than or equal to said thickness.

The tooth holder 2 includes a housing or channel 21 for the pin 3 and a cavity 22 for housing the tensor element 4.

When the system is assembled, first the tensor 4 is introduced inside the cavity 22 of the tooth holder 2, then the tooth 1 is introduced on the tooth holder 2. The apertures 11 of the tooth 1 and the channel or housing 21 of the tooth holder are aligned forming a duct in which the pin 3 is located in the assembly.

When the pin 3 is introduced inside the duct formed by the aperture 11 of the tooth 1 and the housing 21 of the tooth holder 2, the retainer 35 passes through the groove 12 of the tooth. The tooth holder does not have said groove 12 since the retaining element 35 remains between the inner surface 14 of the tooth 1 and the tooth holder 2, more specifically between the tensor element 4 and the inner wall 14 of the tooth 1.

In this introduction/unblocking position of the pin 3, and with the aid of a tool, the pin 3 rotates to the blocking position, the retainer 35 moving through the inclined planes 6 of the tensor 4. In order to overcome said inclined planes 6 of the tensor 4, pressure is applied on the pin 3, and upon applying pressure on pin 3 pressure is applied on the retainer 35, integral with the pin 3, which applies pressure on the tensor 4 which, upon being made of an elastic material, is compressed, allowing the retainer 35 to pass to its blocking position.

In the rotational movement, the ramp 34*a* of the projection 32 of the pin 3 slides through the inclined cavity or ramp 13, adjacent to the aperture 11, of the tooth 1, and the cooperation of the two slopes 34*a* and 13 allows threading the pin 3 a quarter of a rotation inside the tooth 1. In this description the rotation is of a quarter of a turn, but this is only an example, since it could be more than a quarter of a turn or not reach the quarter of a turn.

Contact between the slope of the inclined cavity or ramp 13 of the tooth and the ramp 34*a* of the projection of the pin 32 acts as the first mechanical stop for the unwanted movement in the direction opposite the introduction direction.

The function of the front face 41 is that of contacting with the face 43 of the notch 12 of the hole 11 of the tooth for the pin, acting as a second mechanical stop, limiting the rotation of the pin, also limiting the rotation of the retainer to prevent it from coming out of its inner contact with the tensor.

With the aid of a tool when unblocking, the pin 3 is rotated in the direction opposite that of the assembly direction. The rotational movement is converted into linear movement of the pin 3 which shifts it outwards enough so as to access the pin manually and easily extract it.

Due to the working conditions, the fastening system can be packed by the fines and mud which may enter the system, and the combination of the rotational movement with a longitudinal movement aids in the pin separating from inner walls of the housing 21, coming out of the packing.

Figure 20:
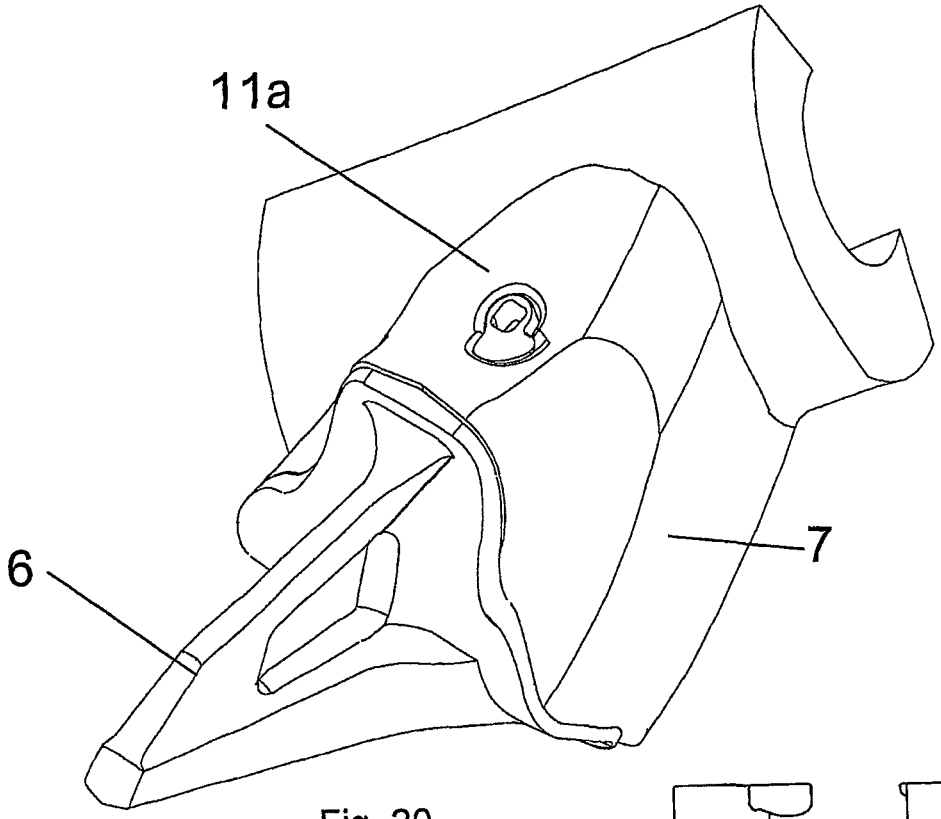
FIG. 20 is a perspective view of a tooth-tooth holder assembly of a bucket of an excavating machine with a device according to another embodiment of the invention, in which the fastening system is introduced vertically and in which the cavity adjacent to the hole of the pin is located in the tooth holder.
Figure 21:
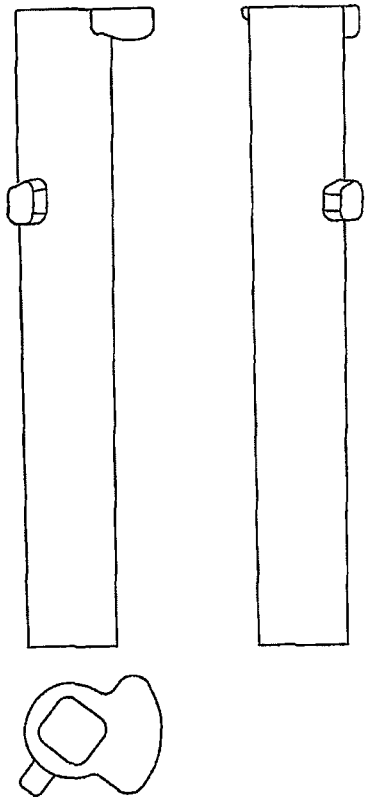
FIG. 21 shows three views of a pin used in the system of FIG. 20.

The drawings show tooth-tooth holder systems in which the pin is introduced through the side of the tooth 1, but it is only an example, since this detachable fastening system can also be used in other systems in which the pin is introduced vertically, as in FIG. 20, or even diagonally.

As previously mentioned, the previous description of the embodiment refers to a system in which it is the tooth holder which has a nose for being introduced in the hollow of the tooth, but as mentioned, the application of the invention to systems in which it is the tooth which has a nose for being introduced in a hollow of the tooth holder is also possible, such that it is the tooth holder which has a hollow for housing the nose of the tooth and it is the tooth holder which has a ramp adjacent to the aperture for the pin to collaborate with the ramp of the projection of said pin, as can be seen in FIG. 20.

The invention claimed is:

1. A female piece used for the movement of earth and stones, comprising a hollow configured to house a nose of a male piece and at least one through aperture for introducing a fastening element or pin, the aperture comprising an inclined surface facing an exterior of the female piece along an axis of the aperture, wherein the inclined surface is helical and a one-piece integral construction with a body portion of the female piece that defines the aperture; and wherein the inclined surface extends asymmetrically in the at least one through aperture in a direction transverse to the axis of the at least one through aperture.

2. The female piece (1, 7) according to claim 1, wherein the inclined surface, when viewed along the axis of the aperture expands radially inward along the helical surface.

3. The female piece (1, 7) according to claim 1, characterized in that the inclined surface is convex.

4. The female piece (1, 7) according to claim 1, characterized in that the inclined surface is planar.

5. The female piece (1, 7) according to claim 1, characterized in that the inclined surface begins with nil depth, coinciding with an outer surface of the female piece (1, 7) and ends in maximum depth (f).

6. The female piece (1, 7) according to claim 1, characterized in that the inclined surface begins with a certain depth, located below the outer surface of the female piece (1, 7) and ends at a maximum height or depth (f).

7. The female piece (1, 7) according to claim 1, wherein the female piece is a tooth (1).

8. The female piece (1, 7) according to claim 1, characterized in that the female piece is a tooth holder (7).

9. The female piece according to claim 1 wherein the helical surface is configured so that rotational movement of the pin that has a protrusion abutting the helical surface is translated into linear axial movement of the pin.

10. The female piece according to claim 9, further comprising the pin having the protrusion configured to abut the helical surface, the pin configured to retain the female piece with the nose of a male piece when the pin is inserted in the aperture.

11. A female piece used for the movement of earth and stones, comprising a hollow configured to house a nose of a male piece and at least one through aperture for introducing a fastening element or pin the aperture comprising an inclined surface facing an exterior of the female piece along an axis of the aperture, wherein the inclined surface is helical and a one-piece integral construction with a body portion of the female piece that defines the aperture; and wherein the inclined surface begins with nil depth, coinciding with an outer surface of the female piece and ends in maximum depth.

12. A detachable fastening system between a male piece and a female piece, of the type used for the movement of earth and stones, comprising the female piece (1, 7) with a hollow therein, configured to house a nose of the male piece (2, 6), and with at least one through aperture (11, 11*a*) in a wall of the female piece, the male piece (2, 6) with the nose configured to be introduced in the hollow of the female piece (1, 7) and a housing (21) arranged in said nose, the entrance to said housing (21) coinciding with the at least one through aperture (11, 11*a*) of the female piece (1, 7) when the nose is introduced in the hollow of the female piece to define a duct through the male piece and the female piece, a pin (3) with a body of revolution (31) and two ends defined as a first end and a second end, the first end configured to be introduced in the duct, said pin (3) having a retaining element (35) on the body close to the second end of the pin, and a tensor element (4) housed in a cavity (22) arranged in an outer surface of the male piece (2, 6) and adjacent to the entrance to the housing (21) therein, the pin (3) has at the second end a projection (32), said projection (32) comprising an upper surface (33) and another lower surface (34), said lower surface (34) having a ramp (34*a*) with a certain inclination, adjacent to said at least one aperture (11, 11*a*) of the female piece (1, 7) is an exterior cavity (13) opened to an exterior of the female piece and with an inclined surface opposite that of the ramp (34*a*) of the projection (32) of the pin (3), and the ramp (34*a*) of the projection of the pin and the inclined surface (13*a*) of the cavity adjacent to the aperture (11, 11*a*) for introducing the pin (3) in the female piece (1, 7) interact to convert a rotational movement of the pin into a linear movement of the pin.

13. The system according to claim 12, characterized in that the female piece (1, 7) is a tooth (1) and the male piece is a tooth holder (2).

14. The system according to claim 12, characterized in that the male piece (2, 6) is a tooth (6) and the female piece is a tooth holder (7).

15. A pin (3), of the type used in the couplings between a female piece (1, 7) and a male piece (2, 6), used for the movement of earth and stones, formed by a body of revolution (31) with two ends, a first end which is introduced in the male piece (2, 6) and a second end (37), opposite the first end, and which is maintained outside said male piece, comprising a retaining element (35) on the body located close to said second end, further comprising at the second end of the pin a projection (32) with an upper surface (33) and a lower surface (34) determining a maximum thickness of the projection, said lower surface (34) having an inclination (34*a*), wherein the body of revolution has a circular cross-section along a substantial length of the pin so as to permit rotation of the pin when inserted into an opening of the female and male piece for coupling the female and male piece.

16. The pin (3) according to claim 15, characterized in that a plan shape of the projection (32) of the pin (3) is formed by an arc tangent to the pin and limited by a plane (41) secant to said pin (3).

17. The pin (3) according to claim 15, characterized in that a plan shape of the projection (32) of the pin (3) is formed by an arc limited by a plane (41) secant to the pin (3).

18. The pin (3) according to claim 15, characterized in that a plan shape of the projection (32) of the pin (3) is formed by an arc and a planar area limited by a plane (41) secant to the pin (3).

19. The pin (3) according to claim 15, characterized in that a plan shape of the projection (32) of the pin (3) is formed by two planes forming an angle with one another.

20. The pin (3) according to claim 15, characterized in that at least one of the two ends (37) of the pin (3) has a coupling for a tool by means of which a rotational movement can be applied to said pin (3) about its longitudinal axis.

21. The pin (3) according to claim 15, characterized in that a ramp (34*a*) included in the lower surface of the projection (32) of the pin (3) is concave.

22. The pin (3) according to claim 15, characterized in that a ramp (34*a*) included in the lower surface of the projection (32) of the pin (3) is convex.

23. The pin (3) according to claim 15, characterized in that a ramp (34*a*) included in the lower surface of the projection (32) of the pin (3) is planar.

24. The pin (3) according to claim 15, characterized in that the inclination of a ramp (34*a*) included in the lower surface of the projection (32) of the pin (3) begins with nil depth, coinciding with the upper surface of the projection (32) and ends in a depth that is sufficient to allow the introduction of the pin (3) the distance necessary for the retainer (35) to be housed between the male piece (2, 6) and the female piece (1, 7).

25. The pin (3) according to claim 15, characterized in that the inclination of the ramp (34*a*) included in the lower surface of the projection (32) of the pin (3) begins with a certain depth, located under the upper surface of the projection (32) and ends in a depth that is sufficient to allow the introduction of the pin (3) the distance necessary for the retainer (35) to be housed between the male piece (2, 6) and the female piece (1, 7).

26. A structure used for the movement of earth, comprising:

a female piece comprising:

a hollow portion defined by walls of the female piece, the hollow portion configured to receive a nose of a male piece; and a hole through at least one of the walls of the female piece, the hole configured to receive an elongated fastening element, the hole having an axis along a length of the hole;

the hole comprising a portion with a helical inclined surface facing an exterior of the female piece along the axis of the hole and configured to cooperate with a projection on the elongated fastening element to translate relative rotational movement of the female piece and the fastening element into relative linear movement of the female piece and the fastening element along the axis of the hole wherein the inclined surface is a one-piece integral construction with a body portion of the female piece that defines the hole; and wherein the inclined surface extends asymmetrically in the hole in a direction transverse to the axis of the hole.

27. The structure according to claim 26, further comprising the elongated fastening element, the fastening element comprising the projection configured to cooperate with the helical inclined surface of the hole to translate relative rotational movement of the female piece and the fastening element into relative linear movement of the female piece and the fastening element along the axis of the hole.

28. The structure according to claim 27, wherein the helical inclined surface is continuous and flat along at least a portion corresponding to a permissible rotation of the fastening element after insertion into the hole.

29. The structure according to claim 28, wherein the helical inclined surface extends for at least a quarter turn.

30. The structure according to claim 27, wherein the projection on the fastening element comprises an inclined surface configured to engage and cooperate with the helical inclined surface of the housing to translate relative rotational movement of the female piece and the fastening element into relative linear movement of the female piece and the fastening element along the axis of the hole.

31. The structure according to claim 30, wherein the inclined surface of the projection is helical.

32. The structure according to claim 27, further comprising the male piece comprising the nose configured to be received in the hollow portion of the female piece, the nose comprising a hole that aligns with the hole of the female piece and configured to receive a portion of the fastening element.

33. The structure according to claim 27, wherein relative rotational movement of the female piece and the fastening element in one direction causes the fastening element to move linearly outwards relative to the hole of the female piece.

34. The structure according to claim 27, wherein the projection on the fastening element cooperates with the helical inclined surface so that the projection on the fastening element is threaded to the female piece upon rotation of the fastening element.

35. The structure according to claim 27, wherein the projection on the fastening element is in the form of a thread crest or helix.

36. The structure according to claim 26, wherein the helical inclined surface of the hole is in the form of a thread.

37. The structure according to claim 26, wherein the female piece is a tooth.

38. The structure according to claim 26, wherein the female piece is a tooth holder.

39. A structure used for the movement of earth, comprising:

one of a tooth or tooth holder comprising a hole having an axis along a length of the hole and configured to receive an elongated fastening element;

the hole comprising a portion with a helical inclined surface facing towards an exterior of the tooth or tooth holder in a direction of the axis of the hole and configured to cooperate with a projection on the elongated fastening element to translate relative rotational movement of the tooth or tooth holder and the fastening element into relative linear movement of the tooth or tooth holder and the fastening element along the axis of the hole; and wherein the inclined surface extends asymmetrically in the hole in a direction transverse to the axis of the hole.

40. The structure according to claim 39, further comprising the elongated fastening element, the fastening element comprising the projection configured to cooperate with the helical inclined surface of the hole to translate relative rotational movement of the tooth or tooth holder and the fastening element into relative linear movement of the tooth or tooth holder and the fastening element along the axis of the hole.

41. The structure according to claim 40, wherein the projection on the fastening element cooperates with the helical inclined surface so that the projection on the fastening element is threaded to the tooth or tooth holder upon rotation of the fastening element.

42. The structure according to claim 41, wherein the projection on the fastening element comprises an inclined surface configured to engage and cooperate with the helical inclined surface to translate relative rotational movement of the tooth or tooth holder and the fastening element into relative linear movement of the tooth or tooth holder and the fastening element along the axis of the hole.

43. The structure according to claim 42, wherein the projection on the fastening element is in the form of a thread crest or helix.

44. The structure of claim 39, wherein a portion of the hole has a keyhole shape defined by a circular opening and a radially extending opening.

* * * * *